US005099751A

United States Patent [19]

Newman et al.

[11] Patent Number: 5,099,751

[45] Date of Patent: *Mar. 31, 1992

[54] CONTROL SYSTEM FOR DOORS OF A NEGATIVE AIR PRESSURE ENCLOSURE

[75] Inventors: Gene Newman, Palm City; Anthony Natale, Jensen Beach, both of Fla.

[73] Assignee: GPAC, Inc., Pennsauken, N.J.

[*] Notice: The portion of the term of this patent subsequent to 05/08/07, has been disclaimed.

[21] Appl. No.: 657,047

[22] Filed: Feb. 19, 1991

Related U.S. Application Data

[63] Continuation-in-part of Ser. No. 519,216, May 7, 1990, Pat. No. 4,993,313, which is a continuation-in-part of Ser. No. 346,621, May 2, 1989, Pat. No. 4,922,806.

[51] Int. Cl.[5] ..... F24F 11/00

[52] U.S. Cl. ..... 454/238; 55/385.2; 454/239; 454/259; 454/191; 454/187

[58] Field of Search ..... 55/385.2, 467; 98/1, 98/1.5, 33.1, 42.09, 42.1, 42.12, 42.16, 42.19, 87, 116, 119; 169/48

[56] References Cited

U.S. PATENT DOCUMENTS

| | | | |
|---|---|---|---|
| 3,107,474 | 10/1963 | Potapenko | 98/1.5 X |
| 3,830,146 | 8/1974 | Kaiser | 98/1.5 X |
| 4,113,175 | 9/1978 | Sutton, Jr. | 98/1.5 X |
| 4,705,066 | 11/1987 | Gut et al. | 98/1.5 X |
| 4,738,189 | 4/1988 | White et al. | 98/1 X |
| 4,850,264 | 7/1989 | Kiser | 98/1.5 |
| 4,911,065 | 3/1990 | Van Becelaere | 98/1 |
| 4,960,041 | 10/1990 | Kiser | 98/1.5 |
| 5,004,483 | 4/1991 | Eller et al. | 98/1.5 |

*Primary Examiner*—Harold Joyce

*Attorney, Agent, or Firm*—Fleit, Jacobson, Cohn, Price, Holman & Stern

[57] ABSTRACT

A decontamination chamber entranceway to an asbestos removal work area includes rigid swinging doors for a rapid escape from the contaminated work area due to an emergency such as a fire or smoke. Also during a power failure it is easy for the workers to leave the work area through the rigid swinging doors of the invention. Each of the doors may include an air inlet opening having at least one plastic flap covering the inlet opening which allows suitable amounts of air to flow through the inlet to maintain a negative air pressure in the work area while having air flow in the work area sufficient to change the air at least every 10 to 15 minutes. The plastic flaps of the doors are preferable pivotally-mounted rigid clear plastic which seal automatically upon loss of negative air pressure in the work area. The rigid flaps can be electro-mechanically operated to positively control size and functioning of air inlet openings and close off the openings upon emergency conditions.

51 Claims, 10 Drawing Sheets

CONTROL SYSTEM FOR DOORS OF A NEGATIVE AIR PRESSURE ENCLOSURE

This application is a continuation-in-part of application Ser. No. 07/519,216, filed May 7, 1990 (now U.S. Pat. No. 4,993,313) which is a continuation-in-part of application Ser. No. 346,621, filed May 2, 1989 (now U.S. Pat. No. 4,922,806).

FIELD OF THE INVENTION

This invention relates to a system and doors for controlling the air flow to a negative air pressure enclosure. The invention controls the air flow inlet or inlets in order to prevent the escape of asbestos-containing air from the enclosure to the outside environment, automatically and under powered operation, upon the loss of or changes in negative air pressure within the enclosure and allows rapid escape of personnel from the enclosure. In addition, an indication of fire inside or outside of the enclosure can automatically close the air inlet openings directly or can be transmitted to a supervised control panel which controls the air inlet openings.

BACKGROUND OF THE INVENTION

The basic patent for establishing a negative pressure, air flow enclosure for an asbestos removal work area within a building is U.S. Pat. No. 4,604,111. This patent discloses a particulate contamination control method and filtration device, and a system for establishing a negative pressure, air flow enclosure. This patent addresses the serious dangers associated with persons breathing particulate contaminated air. The invention is useful for protecting the outside environment and the individuals working in a highly contaminated area such as occurs when asbestos coatings and other asbestos materials are removed inside a building structure.

Asbestos fibers fall into the generic classification of hazardous particulate and are a well known carcinogenic hazard to humans and animals. Typical environmental standards refer to fibers that are 5 microns or greater in length with an aspect ratio of 3 to 1 or greater. The average asbestos fiber is about 0.1 micron in diameter. It is now accepted that the thinner fibers are the most dangerous threat to human health. The asbestos fibers, in particular those that are thinner and shorter, remain airborne for considerable lengths of time and contaminate large volumes of air to form a substantial hazard to the environment and to the persons working or living in the area.

U.S. Pat. No. 4,604,111 provides a system and method of containing, lowering, and essentially eliminating the danger of asbestos escaping from an asbestos removal work area in a building where asbestos fibers are generated at extremely high levels. Airborne asbestos fibers are prevented from being released to the outside environment during an unforseen accident such as a leak through a damaged film barrier and by a flap seal arrangement which seals the inlet to the contaminated work area through which workers pass to gain entrance to and exit from the work area.

The flap seal arrangement is formed in the plastic wall defining the work area and is utilized in the doorways of the decontamination chamber, as well as the waste chamber for removed asbestos, equipment and the like. As disclosed in the '111 patent, a sheet of plastic film is sealed across a door frame with an opening cut through the film. The preferred opening is disclosed as a two foot by five foot opening about a foot off the floor, and the plastic film is polyethylene, plasticized polyvinyl chloride or the like. The "flap seal" is larger in all dimensions than the opening of the same film, is attached to the door frame above the opening and hangs over the full length of the opening such that air and the workers may pass into the work area through the opening, pushing the flap inwardly. The configuration is such that once the air flow ceases and negative air pressure is lost in the enclosure, the flap falls into place and air is prevented from escaping in the opposite direction to the environment outside of the work room.

Many similar plastic film "flap seal" arrangements are in use today. These include various double and triple flap arrangements that permit workers to pass into and out of the work area while at the same time providing an air inlet opening sufficient to allow substantial air flow through the flap arrangement and into the work area and which automatically close upon loss of negative air pressure in the work area.

In these various flaps seal arrangements in accordance with the '111 patent, the flap seal arrangement is designed to seal the air inlet into the contaminated work area. This arrangement has proven to be very effective in preventing escape of asbestos fibers in the event of loss of negative air pressure. However, other factors need to be considered in designing a combined entrance and exit from the contaminated work area. For example, it is often very difficult to pass through these entrance/exitways in the event of fire or the like.

In U.S. Pat. No. 4,818,970, a fire condition detection and control system for air moving and filtering units is disclosed. The fire condition detection and control system is for use with air moving and filtering units such as those disclosed in the '111 patent. The fire condition detection and control system includes one or more remote fire condition detection units, which sense heat or smoke and, upon such sensing, transmit a signal indicative of an alarm condition to one or more air moving and filtering units located within the containment enclosure. The transmission is by wireless radio frequency transmission and/or a wired transmission line or cable. The air moving and filtering unit detects the alarm condition and disconnects power to the blower motor of the air moving and filtering unit. The receiver and control circuitry may be integral with the air moving and filtering unit, or may be part of a separate control unit that plugs into conventional air moving and filtering units.

SUMMARY OF THE INVENTION

By the present invention, an improved entranceway to an asbestos contaminated work area is provided. Instead of plastic flap arrangements, a solid door is employed in the present invention. This solid door swings to allow a rapid escape from the contaminated work area in the event of an emergency such as a fire and the dangers posed by exposure to smoke. Also during a power failure it is easy for the workers to leave the work area. The immediate exiting from the work area is thereby greatly facilitated by the solid swinging doors of the invention.

The solid swinging doors of the present invention each include an air inlet opening having at least one flap covering the inlet which allows suitable amounts of air to flow through the inlet to maintain a negative air pressure in the work area while at the same time provide sufficient air flow so that the air in the work area is changed at least every 10 to 15 minutes. The plastic flaps of the doorway seal automatically upon loss of negative air pressure in the work area. The doors may each have a transparent portion through which the work area or an adjacent room of a decontamination chamber may be observed.

In one embodiment of the invention, the flap covering the opening in the solid door is a flexible plastic sheet, such as plastic film or the like, attached along its top edge to the door above the opening. In a more preferred embodiment, the flap is a rigid plastic material of sufficient size to seal the opening when closed. Similar solid doors with inlet openings and plastic flaps should be utilized for the doorways associated with the waste chamber.

A further feature of the present invention when rigid plastic flaps are utilized, is the use of motorization to open or close the flaps in response to changes in the pressure within the work area and/or to shut the flaps completely with positive force in the event of detection of fire or smoke.

Accordingly, a primary object of the present invention is to provide solid swinging doors for access into and out of an enclosed asbestos removal work area which have a sealable air inlet opening sufficient to maintain a negative air pressure and air flow in the work area, while at the same time allowing a quick exit from the work area in the event of an emergency.

It is another object of the present invention to equip the air inlet opening in the door with a flap seal on one side of the door so that make up air passes into the work area through the air inlet opening and the flap seal is closed upon the loss of negative air pressure in the enclosed work area.

A further primary object of the present invention is to provide flap seals made of rigid materials which can close automatically by gravity, or can be electromechanically controlled to prescribed opening dimensions and closed with positive sealing forces irrespective of relative pressure conditions within the enclosed work area.

It is still another object of the present invention to provide doors to the enclosed work area which can be controlled to swing to a partially open position to allow air flow in the enclosed work area to maintain a negative pressure and air flow in the work area and to close upon the loss of negative air pressure in the work area while allowing a quick exit from the work area in the event of an emergency.

It is yet another object of the present invention to provide a control system for doors of a negative air pressure enclosure which is responsive to a smoke or heat detection signal from at least one fire/smoke sensor located in an least two separate areas inside or outside of the containment enclosure.

It is still yet another object of the present invention to provide a control system for doors of a negative air pressure enclosure which is responsive to a smoke or heat detection signal from at least one fire/smoke sensor located in an least two separate areas inside or outside of the containment enclosure with a supervised control panel with indicators and alarms to regulate the response to detection of smoke or fire by at least one sensor from at least two sensors in at least two separate areas.

Yet another important object of the present invention is to provide a system of solid entry doors with air inlet openings and rigid flap seals together with auxiliary openings with rigid flap seals which can be electromechanically controlled to size respective air inlet openings in order to maintain a desired negative air pressure in the work area, maintain a desired air flow through the accessways into and out of the work area and positively close all air inlet openings in the event of fire or smoke detection.

These and other objects of the present invention, as well as many of the intended advantages thereof, will become more readily apparent when reference is made to the following description of the preferred embodiments taken in conjunction with the accompanying drawings.

BRIEF DESCRIPTION OF THE DRAWINGS OF THE PREFERRED EMBODIMENTS

DETAILED DESCRIPTION OF THE PREFERRED EMBODIMENTS

Figure 1:
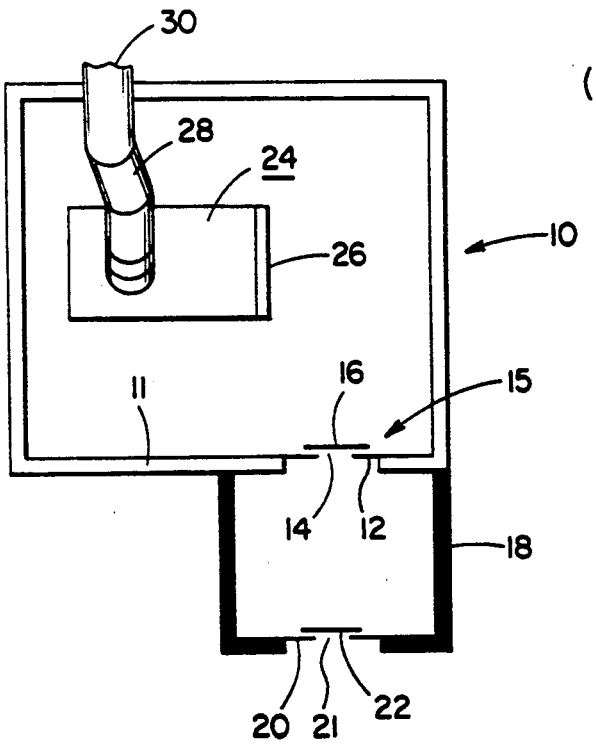
FIG. 1 (PRIOR ART)
FIG. 1 is a floor plan illustrating the use of a prior art entranceway for a particulate contamination control enclosure taken from the '111 patent.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 illustrates the prior practice wherein on the job site, enclosure 10 surrounds an area of high particulate accumulation. This illustrates the embodiment wherein a sealed room is constructed around the area of contamination in its most simple configuration. For the purposes of this figure and of the other floor plans of FIGS. 2, 15 and 18, the floor and ceiling are in all cases present to complete the enclosure. However, it should be understood that air intakes or inlets, control for air flow, exit ports or outlets and even doorways can be constructed to enter through the roof or through the floor in the same fashion as they are illustrated as passing through the walls shown in FIGS. 1, 2, 15 and 18. Whenever the term "wall" is used, it is intended to include any of the four vertical walls as well as the ceiling or the floor.

Decontamination chamber 18 is constructed to allow entrance to and exit from enclosure 10 through doorway 15 into the chamber, closed from the outside with flap 22 over opening 21 in film barrier 20. Air moving and filtration system 24 is placed in the contamination area in enclosure 10 such that air entering port 26 is filtered through a HEPA filter and expelled to the environment through air communication duct 28 to exit vent 30 with 99.99 percent of the particulate contaminants of 0.3 micron size removed. The filtration system 24 in FIG. 1 is illustrated larger than scale and is preferably placed in a part of the enclosure near the contamination source so that the particulate, such as asbestos coatings, may be removed while maintaining the airborne particulate concentration in the work area at a satisfactory level. The substantial air flow being pulled into the filtration means provides a continuous vacuum in enclosure 10 drawing significant air through the flap seals and maintaining a negative pressure in the room at all times. The filtration unit is particularly effective when the source of contamination, typically the asbestos source being worked on is between the air inlet and the filtration system 24.

Figure 2:
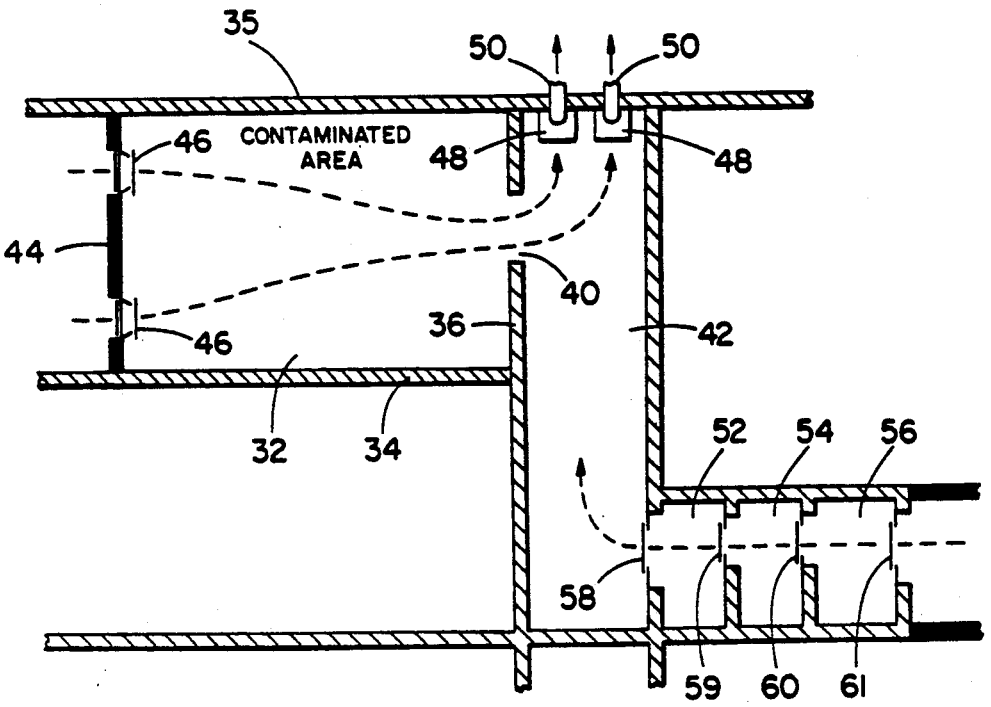
FIG. 2 (PRIOR ART)
FIG. 2 is an additional floor plan illustrating the erection of a decontamination chamber using a prior art entranceway for a particulate contamination control enclosure taken from the '111 patent.

In FIG. 2, a somewhat more complicated configuration is illustrated. In this configuration, the contaminated area is in room 32 for which there are three permanent walls 34, 35 and 36 with doorway 40 opening in wall 36 from room 32 to hallway 42. Doorway 40 is maintained in an open condition and any existing doors are removed or fixed in the open position.

Wall 44 is a temporary film wall constructed from floor to ceiling to establish the enclosed work area. This wall 44 is constructed with two inlet openings with flap seals 46 providing for controlled air flow into room 32. The position of the walls 34, 35, 36 and 44 form a barrier to cause the air to flow past the work area and away from the workers through the contaminated area and doorway 40 into hallway 42 by means of a pair of filtration units 48. The filtration units expelling air through exit ports 50 with the general air flow shown by the dotted lines and arrows.

Located on the opposite end of hallway 42 is a decontamination chamber, including a series of three rooms, dressing (dirty) room 52, shower room 54 and dressing (clean) room 56, containing various decontamination equipment and safety devices including showers, clothing discard systems and vacuum removal, with each successive decontamination room being cleaner and cleaner toward the outside environment as each is equipped and separated from the other with openings and flap seals 59 and 60. These flap seals are large enough that a person can enter and leave through the opening by pushing the flap aside. The doorway between hallway 42 and dressing (dirty) room 52 is also equipped with a similar flap seal 58 as is dressing (clean) room 56 with flap seal 61, to the outside environment.

Air flow is allowed through the flap seals, through the successive decontamination rooms, into hallway 42, to be pulled to filter systems 48 to be expelled into the atmosphere after particulate contamination has been removed. In this configuration, clean air is being drawn into and through essentially all areas of the decontaminated chamber, and airborne particulate is being drawn away from the work place, out of the room and away from persons working in room 32.

Figure 3:
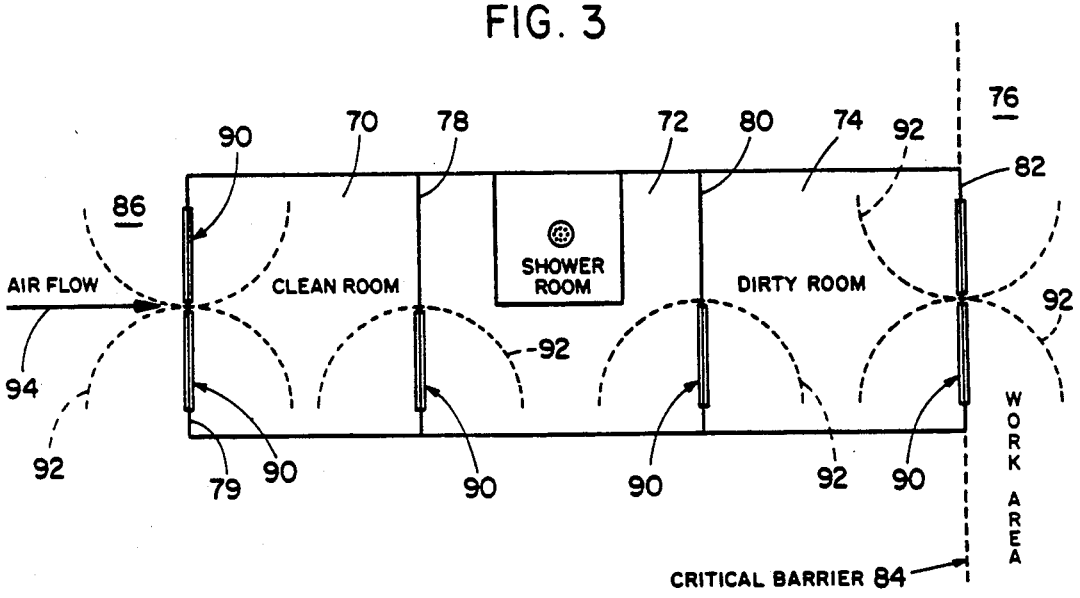
FIG. 3 is a plan view of a decontamination chamber having the solid swinging doors of the present invention.

In FIG. 3, a decontamination chamber similar to that of FIG. 2 is shown in that clean room 70 is separated from shower room 72 and dirty room 74 which leads into work area 76. An enclosed work area as explained with reference to FIGS. 1 and 2 is intended to be shown by work area 76. Solid wall 78 separates clean room 70 and shower room 72 whereas solid wall 80 separates the shower room 72 from dirty room 74. Wall 82 separates the dirty room 74 from work area 76. A critical barrier 84 extends beyond the edges of wall 82 to define the limits of work area 76. The critical barrier may be a solid wall or temporary film wall construction. Walls 78, 80, and 82 may be a pre-existing wall, a wall built for the decontamination chamber or be of temporary film wall construction.

To gain access from the clean area 86 to the clean room 70, from the clean room 70 to the shower room 72, from the shower room 72 to the dirty room 74, and from the dirty room 74 to the work area 76, there exists a series of single or double negative air pressure doors 90. A path of movement of an inner edge of each of the doors 90 is shown by dotted lines 92. An opposite outer edge of the door is pivotally mounted in a respective wall or door frame for free swinging movement of the doors 90 through 180° of movement.

Figure 4:
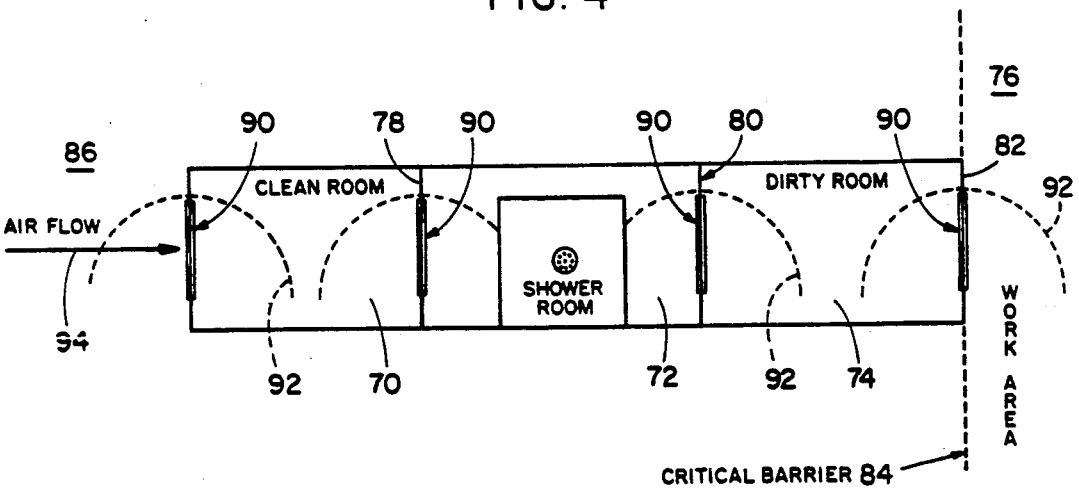
FIG. 4 is a plan view of another decontamination chamber having the solid swinging doors of the invention.

Air flow, as represented by arrow 94, is from the clean area 86 into the clean room 70, into the shower room 72, into the dirty room 74 and into the work area 76. A difference between FIGS. 3 and 4 is that in FIG. 4 all single doors 90 are used whereas in FIG. 3, double doors 90 are mounted in walls 79 and 82. The purpose of the doors and their special functioning is best explained with reference to FIGS. 5 through 10.

Figure 5:
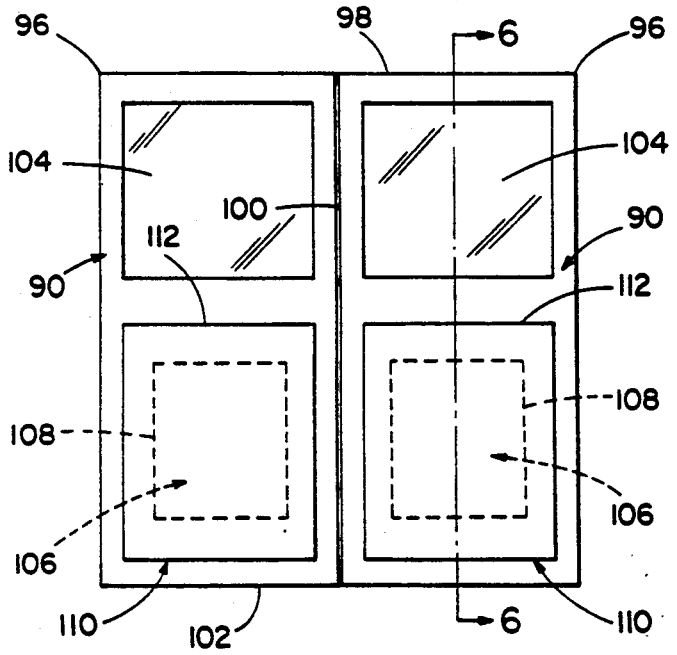
FIG. 5 is a front elevation view of a set of double doors according to the present invention.
Figure 7:
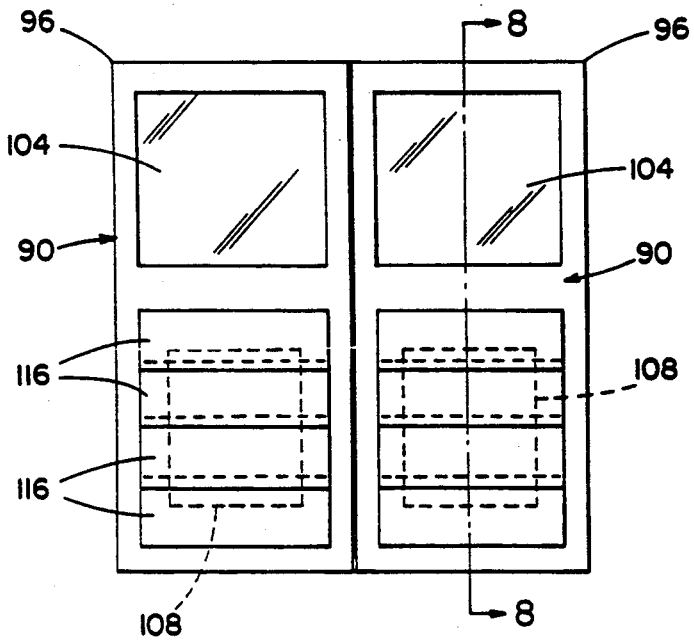
FIG. 7 is a front elevation view of a set of double doors according to an alternative embodiment of the present invention.

As shown in FIGS. 5 and 7, double doors 90 are shown as illustrated in FIG. 3 for the entrance to the clean room and for the entrance from the dirty room to the work area. Doors 90 are solid swinging doors capable of 180° movement about pivots or hinges located at the anchored outer edges 96 of the doors and mounted in door frames or walls. At edges 96, and at top edge 98, inner edge 100 and bottom edge 102 are air-sealing gaskets formed of rubber strips or the like (not shown) which seal the space between the doors and the frames within which the doors are mounted when the doors are in a closed position. The gaskets prevent the movement of air around the doors. The gaskets are preferably mounted on the doors themselves inasmuch as the doors are likely to be manufactured whereas the door frame is normally constructed at the job site.

In the closed position, viewing into an adjacent chamber of the decontamination chamber or into the work area or surrounding clean area 86, is facilitated through windows 104 which are preferably made of clear plastic, one-quarter inch thick. In FIGS. 5 and 7, the windows 104 are located in the top portion of the doors; however, it is not necessary that the windows be so located or actually be included. In the bottom portion of the doors 90 in FIGS. 5 and 7, is provided an air inlet 106 which is formed by peripheral edges 108 shown in dotted lines and in full lines in FIGS. 6 and 8.

In FIG. 5, a flexible plastic flap 110 is mounted at a top edge 112 on a side of the door 90 facing towards the work area 76. By the use of an air moving and filtering device within the work area there is a constant air flow towards the work area as shown by arrow 114 in FIG. 6. The air movement causes the flexible plastic flap 110 to move towards the work area and provides air flow through the air inlet 106. Upon termination of power to the air moving and filtering device, or upon loss of negative air pressure for any reason, the flexible plastic flap will return to a position paralleling the surface of the door 90 so as to seal the air inlet 106 against egress of air from the work area towards the clean area 86. A positive air pressure builds up within the work area 76 and forces the flap 110 against the door and seals the flow of asbestos fiber contaminated air out of the work area.

Figure 6:
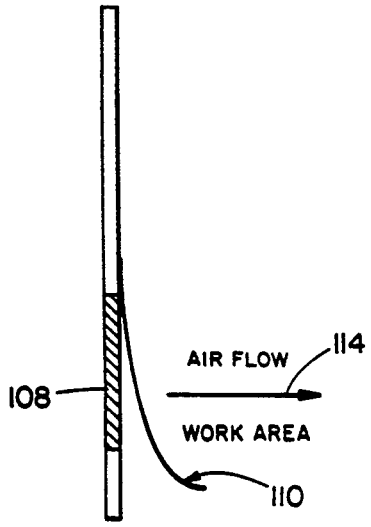
FIG. 6 is a sectional view taken along line 6—6 of FIG. 5 showing the flap made of flexible plastic film.
Figure 8:
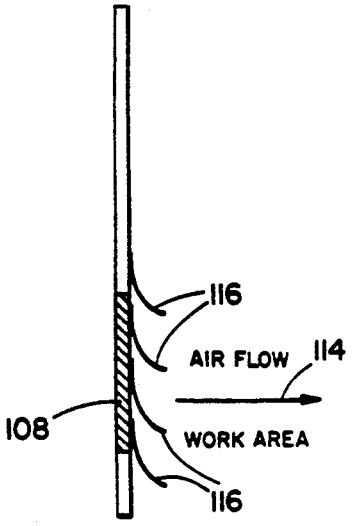
FIG. 8 is a sectional view taken along lines 8—8 of FIG. 7.
Figure 9:
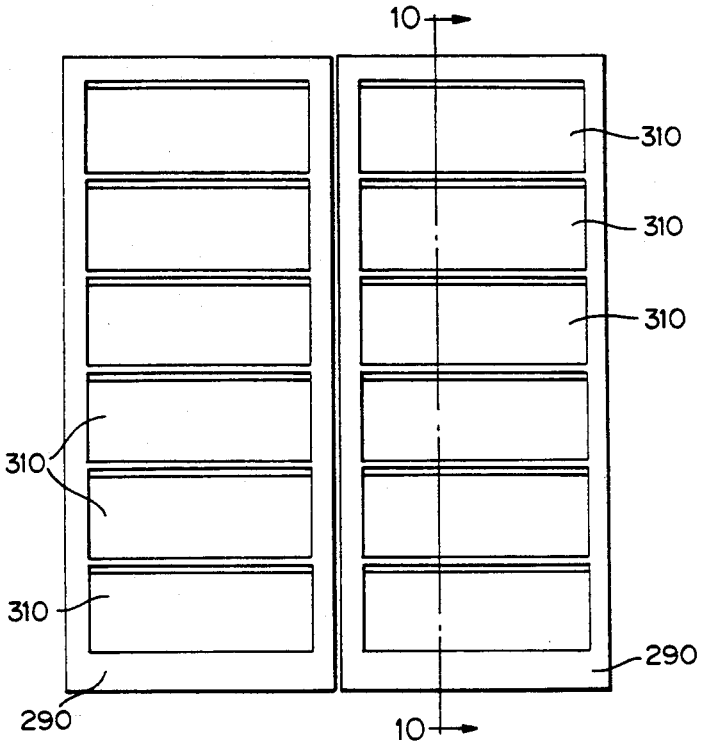
FIG. 9 is a front elevation view of a set of double doors according to the present invention with the flaps made of rigid plastic material.
Figure 10:
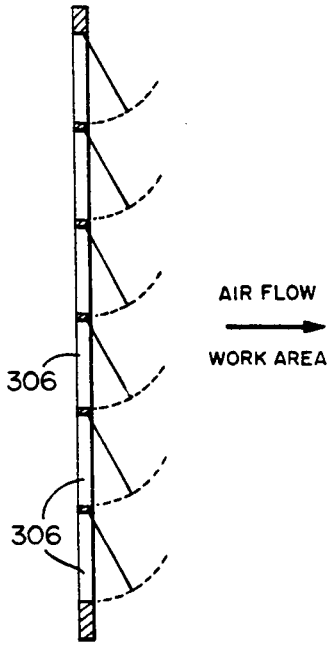
FIG. 10 is a sectional view taken along lines 10—10 of FIG. 9 showing the rigid flaps open during air flow.
Figure 11:
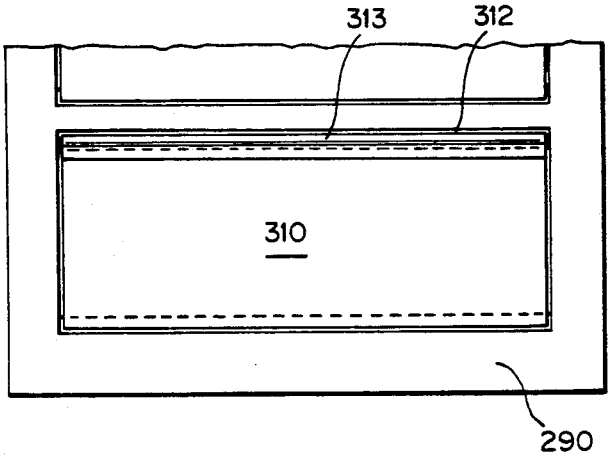
FIG. 11 is an enlarged view of a single rigid flap in accordance with the present invention.

Similarly, in FIGS. 7 and 8, a series of partially overlapping flexible plastic flap louvers 116 made of plastic strips are mounted along their top edge to the interior surface of the door, as best shown in FIG. 8 to form a series of flap seals similar to the flap seal formed by flexible plastic flap 110 in FIGS. 5 and 6. The same result is achieved by the flap louvers in FIG. 7 as is accomplished by the single flexible plastic flap 110 in FIG. 5. It is appreciated that the flaps 110 and 116 can be located at the top, the bottom or middle of the door and be of any size to suit the cubic foot per minute requirements for air movement through an air inlet.

An alternative solid door and flap seal arrangement is shown in FIGS. 9–12. In this embodiment, solid doors 290 are provided with a series of air inlet openings 306 (six are shown) and a series of rigid flaps 310 (also six shown) mounted on the door 290 along their top edge 312 on pivoting element 313. The rigid flaps 310 are preferably made of clear plastic approximately ⅛ inch thick to provide rigidity to the flap and allow one to see through the door. This arrangement can eliminate the need for a fixed window in the door, such as shown in FIGS. 5 and 7.

Figure 12:
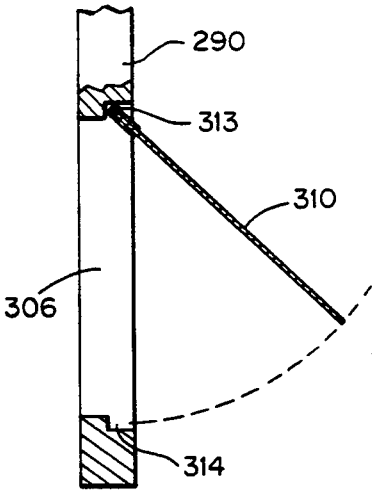
FIG. 12 is a side view of the single rigid flap of FIG. 11 with recess mounting.

As shown in FIG. 12, the door 290, door opening 306, and rigid flap 310 maybe constructed so that the flap fits into a recess 314 within the door opening 306. In any event, the flap 310 and door opening 306 are suitably equipped with gasket seals or the like (not shown) to ensure that the flaps 310 seal the air inlet opening 306 when closed. Further, if desired, the pivot element 313 can be the only element dividing the air inlet openings 306, and the lower edge of each flap can be extended to overlap the top of the next lower flap when closed.

Figure 14:
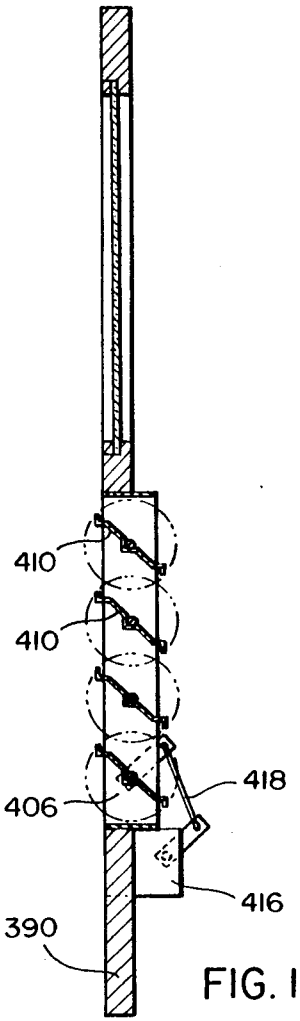
FIG. 14 is a sectional view taken along lines 14—14 of FIG. 13.
Figure 13:
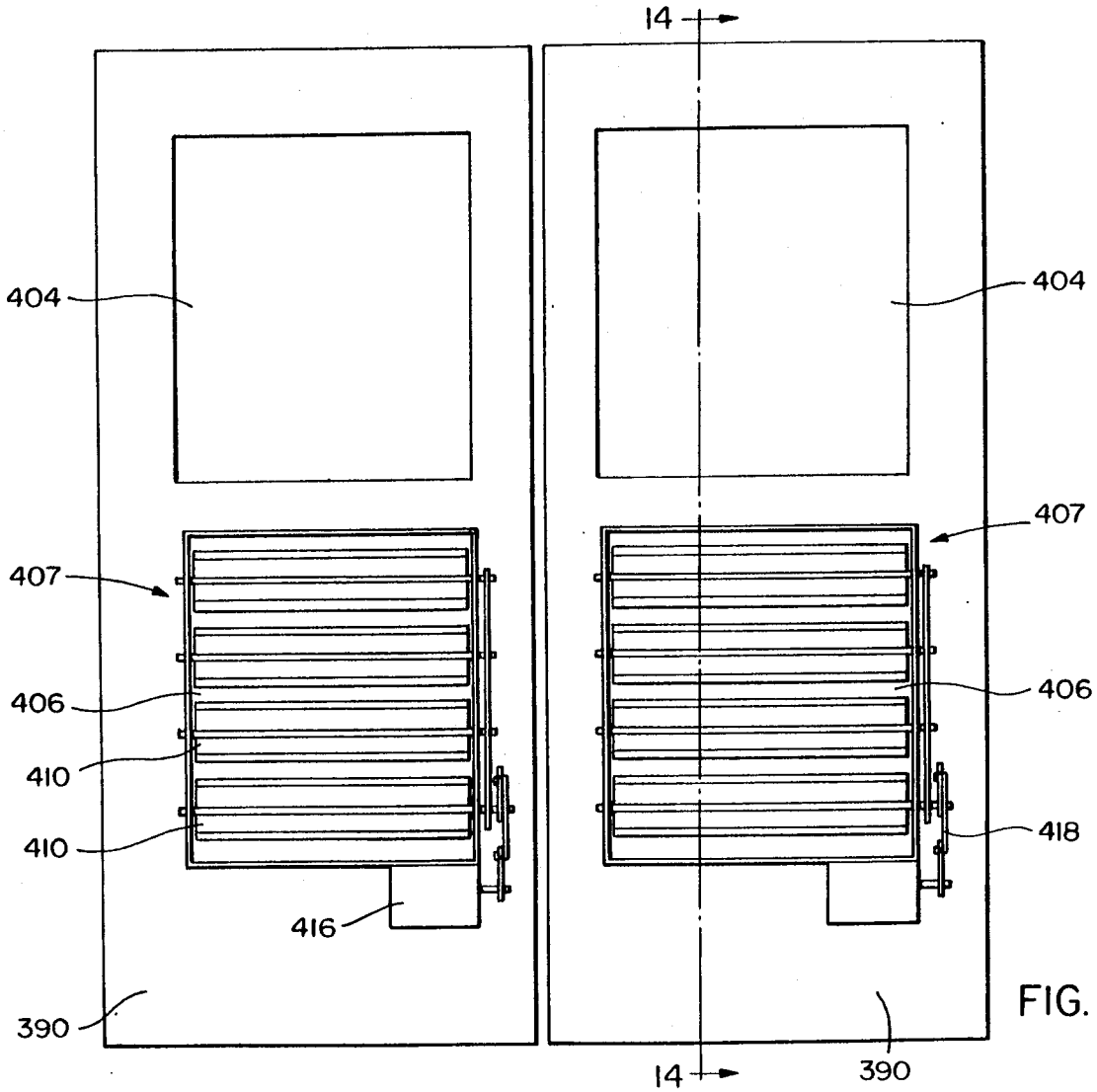
FIG. 13 is a front elevational view of a set of double doors according to a further embodiment of the present invention.

A further modification of the solid door, rigid flap seal system is shown in FIGS. 13 and 14. In this embodiment, solid doors 390 are equipped with fixed windows 404 in the upper part and an opening 406 in the lower part. The opening 406 is fitted with a damper system 407 comprising a series of rigid flap seals or damper blades 410 (four per door shown). These damper blades 410 are electro-mechanically operated and controlled by a damper motor 416 through mechanical linkage 418 between a completely closed position and a fully open position. By electro-mechanical operation and control of the flap seals 410, the size of the air inlet 406 and therefore the air flow into the work area by means of the air moving and filtering machines can be positively controlled. This control can be achieved by monitoring the relative negative pressure in the work area or can be independent of the pressure in the work area, depending on the control signal to the damper motor 416. Further, the motor 416 can close the flap seals 410 under a positive force to ensure that the openings 406 are fully closed and sealed.

It will also be seen that the damper system 407 illustrated in FIGS. 13 and 14 is what is known as a parallel blade damper. Opposed blade dampers or other type damper systems known in art can also be used. Further, the damper blades, such as blades 410, include sealing gaskets or the like (not shown) in order to seal the damper system to all air movement when closed, as is well known in the art.

The doors 290 and 390 with openings and rigid flaps, with and without electro-mechanical motors 416 and mechanical linkage 418, lend themselves to ready manufacture from aluminum extrusions and the like at manufacturing locations away from the asbestos removal job site. The rigid plastic flaps can be mounted in appropriate extrusion strips which grip an edge of the plastic and hold it in place. The prefabricated doors can be delivered to the job site. Once delivered, the doors can be installed in a constructed door frame at the job site. The door frame is built at the same time as the temporary walls for the enclosure are constructed and is normally made from standard construction materials, such as wooden 2×4 studs and the like. When the job is completed, the prefabricated doors can be removed and used again on subsequent jobs.

Further, the doors 90, 290, and 390 can be equipped along their bottom edge with a soft sweep strip or sealing gasket as thick as 4 to 5 inches, rather than just a narrow sealing gasket. Such a thick, soft sweep strip would permit hoses, electric cables, door threshold and the like for equipment used in the work space to extend underneath the doors. In addition, the doors 90, 290 and 390 should be self-closing by a spring, gravity, weights, eccentric cam, or the like for constant return of the doors to a closed sealing position with their inner edges adjacent each other to allow passage of air from the clean area to the work area through the air inlets, viewing of an adjacent area or room through windows or clear flaps and access for the workers to enter or leave the work area through the doors.

During an emergency situation in the work area, the workers may quickly escape from the work area by merely pushing on any portion of the door 90, 290 or 390. The doors will rapidly swing open in a direction away from the work area to provide an unhindered path of egress. This design proves much more effective than attempting to pass through a design of overlapping plastic sheets which must be carefully maneuvered to allow passage of personnel.

The closures for the doors 90, 290 and 390 should be of sufficient strength to resist any tendency to open outwardly when the flap seals are closed due to loss of negative pressure in the work area and a build up of positive pressure therein (versus the pressure outside the work area). But the strength should not be so much as to prevent ready egress of workers from the work area in the event of fire or other emergency.

Figure 19A:
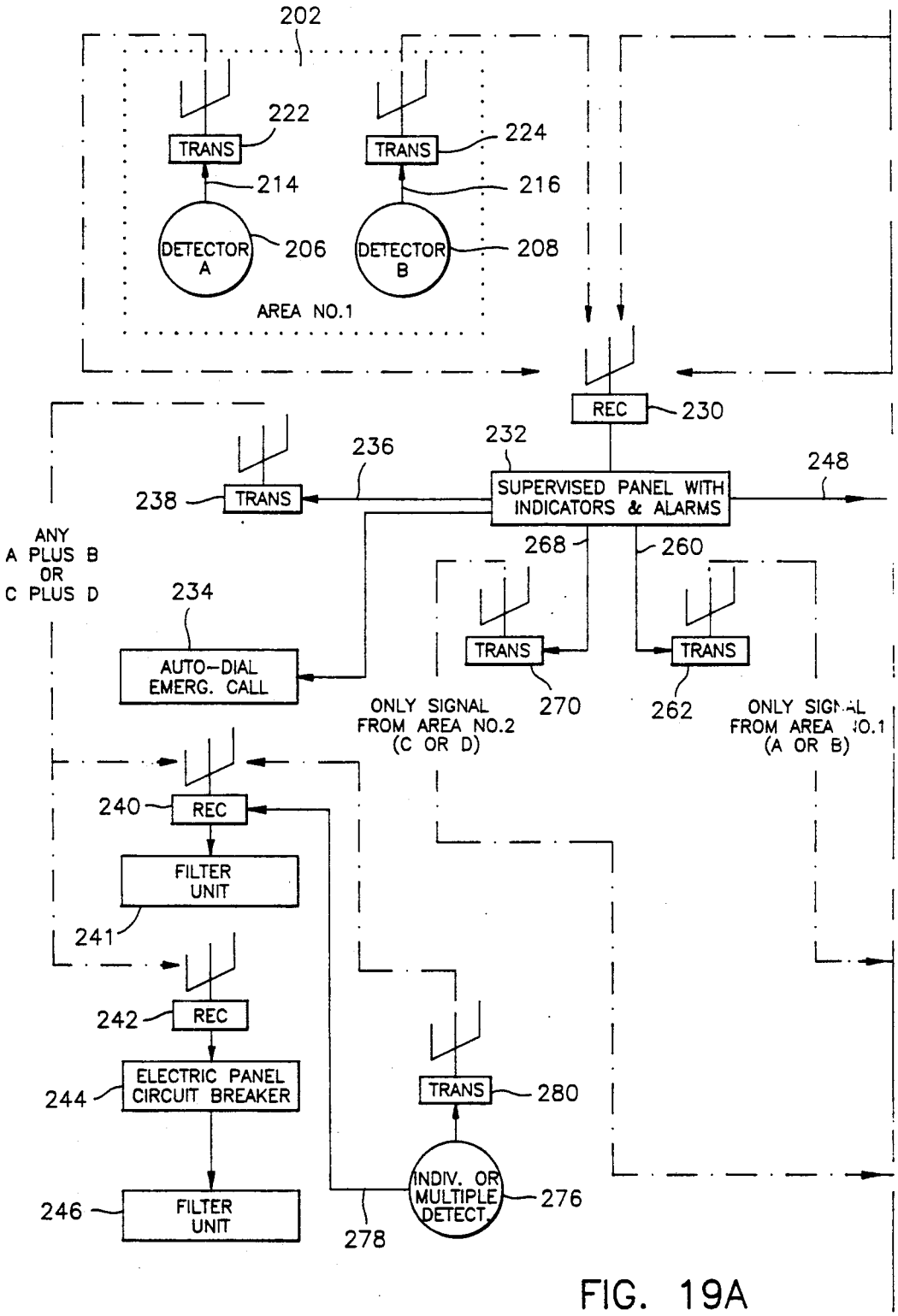
FIGS. 19A and 19B are a schematic view of a control system for a negative air pressure enclosure in accordance with the present invention.
Figure 19B:
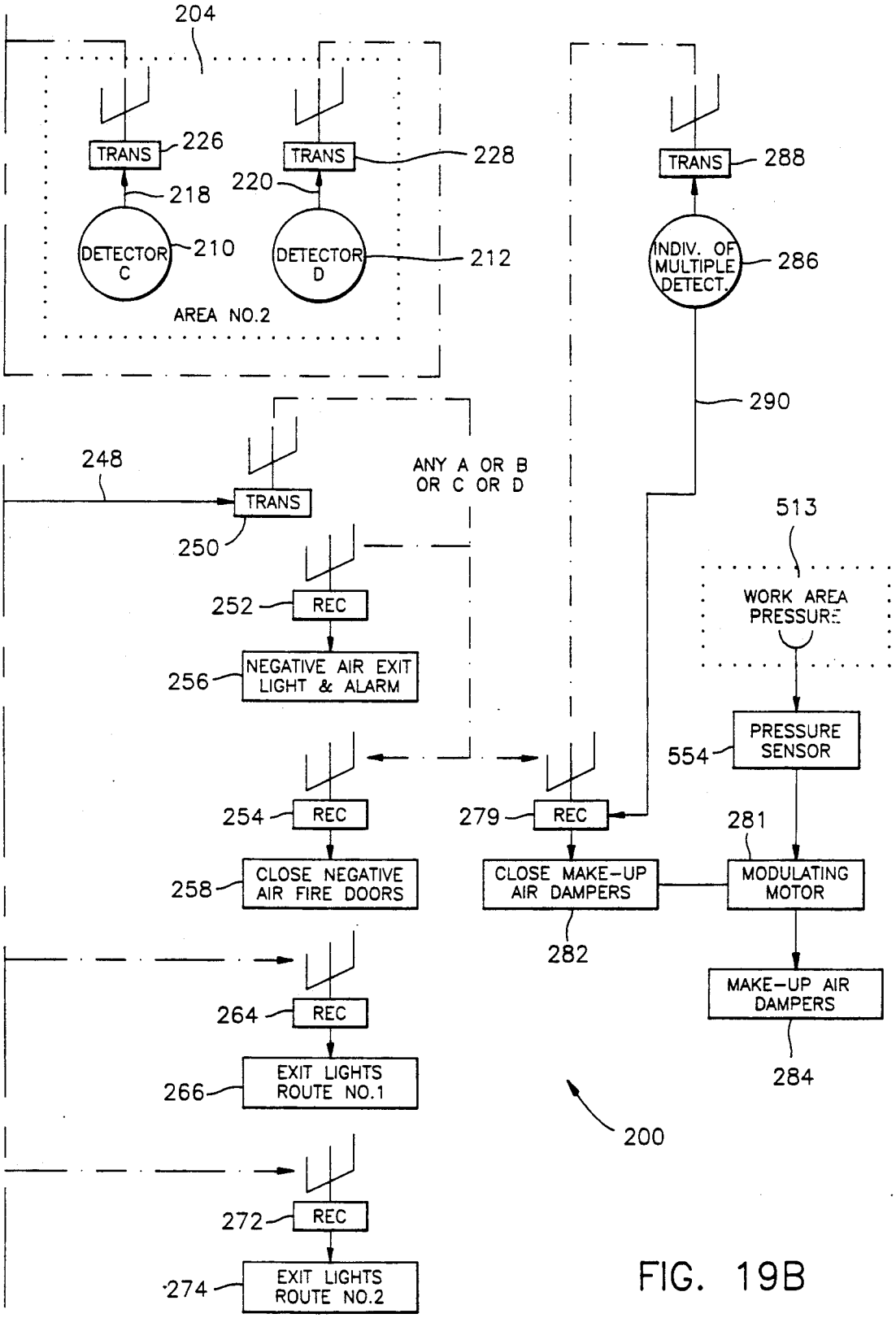

As described previously, the damper system 407 is electro-mechanically operated and controlled and thus the size of the air inlet opening 406 can be controlled to regulate the amount of air being drawn into the enclosed work area, whether based upon a measured work area pressure differential or some other condition in the building. The damper system is controlled so as to close the damper blades 410 immediately upon loss of negative pressure in the work area beyond a predetermined differential pressure threshold. In addition, the damper system 407 should be controlled so that the damper blades 410 will immediately close shut upon receipt of a smoke/fire signal, such as shown in FIG. 19, other type emergency signal, loss of power signal or any other contingency which might endanger workers in the enclosed work area due to high air movement required of an asbestos particulate contamination control system. Such deactivation, of course, must not impede the doors from swinging open so that personnel trapped within the work area can make a quick exit.

As an alternative embodiment to doors with air flow inlets and flap seals, the doors 90 may be of solid, imperforate construction. In this embodiment, the solid doors are electromechanically operated and controlled to open to varying degrees, for example, into the work area. The door operation responds to a signal to open the doors to a slight degree as required to maintain a predetermined negative air pressure setting for the work area. The amount of opening of the doors is dependent upon the amount of air needed to flow into the work area in place of the air inlets, such as inlets 108. The doors may automatically close upon receipt of a smoke/fire signal as shown in FIG. 19, an emergency signal, a power failure signal, etc. to prevent escape of contaminated asbestos while allowing the workers to leave the work area quickly.

Similarly, the solid doors (without an air inlet) may be opened by a motor to a controlled amount to regulate the amount of air being drawn into the enclosed work area based upon a measured work area differential pressure. However, the door itself, like the embodiment of the door with flaps over an air inlet, will have its motor deactivated so as to close upon loss of negative air pressure beyond a predetermined differential pressure threshold. In addition, the door will close by deactivation of its opening motor upon receipt of a smoke/-fire signal, such as shown in FIG. 19, or other emergency signal, loss of power signal or any other contingency which might endanger workers in the enclosed work area due to high air movement requirements of an asbestos particle contamination control system. The doors are pivotally mounted in a frame so that the personnel trapped within the enclosed work area when the doors automatically move to their closed position may make a quick exit in an emergency, and the doors will return to their closed position to prevent further escape of asbestos contaminated air.

Although FIGS. 9–14 show a pair of doors for each doorway, it will be apparent that a single door having the same construction can suffice. Double doors may provide some advantage in facilitating egress in the event of an emergency and may be preferable since they would be narrower for the same size opening. However, either arrangement is fully contemplated for the present invention.

Figure 15:
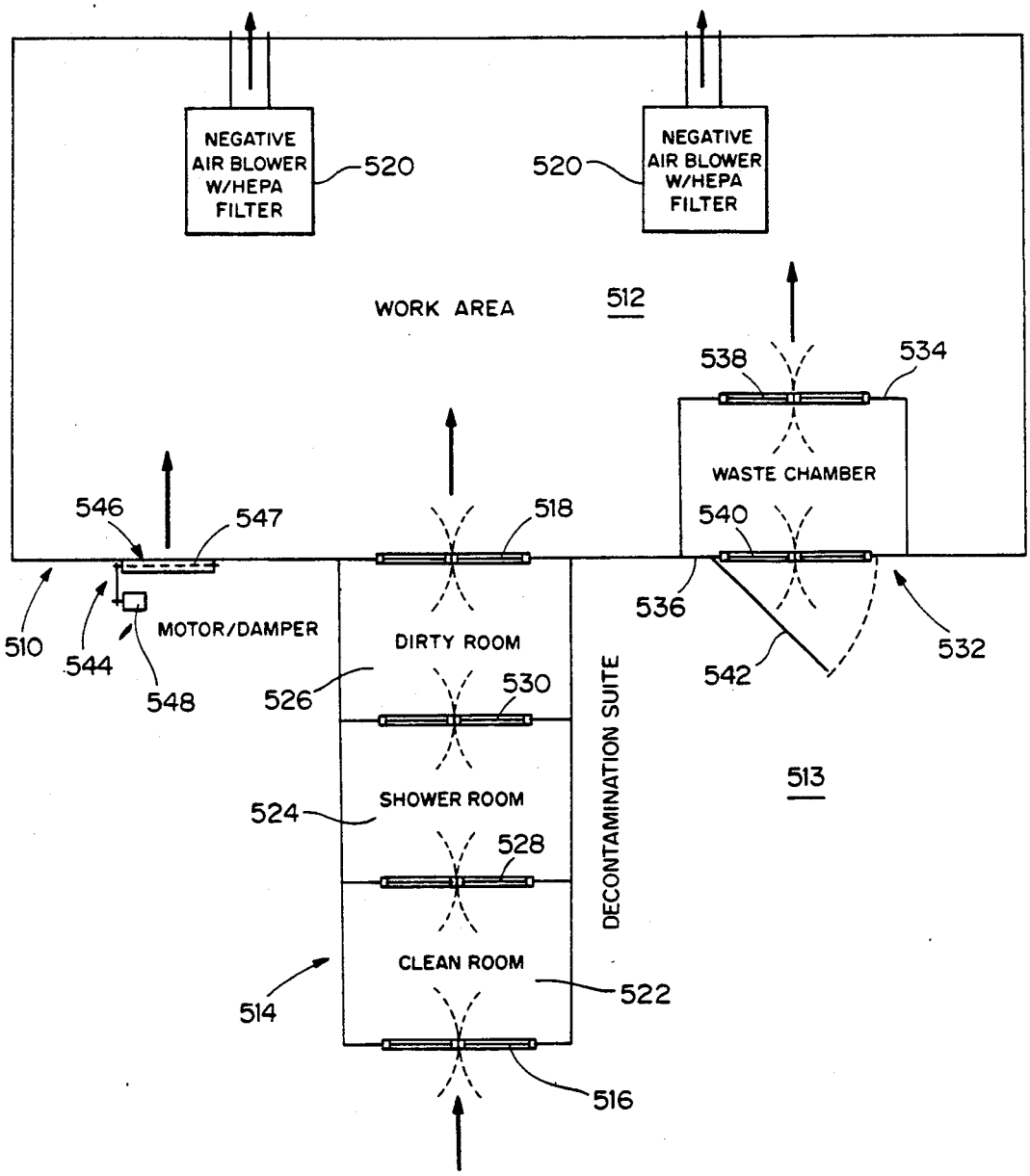
FIG. 15 is a floor plan of a work area, decontamination chamber, waste chamber and auxiliary air inlet using features of the present invention.

Turning now to FIG. 15, there is shown a system for controlling the airborne contamination in an asbestos removal work area embodying the features of the present invention. Enclosure 510 surrounds an area of high particulate contamination, or work area 512, to separate it from the outside environment of the building 513. Decontamination chamber or suite 514 is constructed to allow entrance to and exit from enclosure 510 through doorway 516 into the chamber and doorway 518 into the work area. Air moving and filtration units 520 equipped with HEPA filters are placed in the contamination work area 512 in a known manner to draw substantial volumes of air into the work area through the decontamination chamber 514 and other air inlet openings in the walls of enclosure 510, as will be described hereinafter. The arrows indicate the direction of air flow under the influence of the air moving units 520.

The decontamination suite 514 is divided into the conventional clean room 522, shower room 524, and dirty room 526, which are separated by doorways 528 and 530. The doorways 516, 528, 530 and 518, starting from the outside environment and going into the work area are all equipped with doors in accordance with the present invention, such as the doors illustrated in FIGS. 9–12. Preferably, at least one pair of these doors is made in accordance with the embodiment of door construction shown in FIGS. 13 and 14.

Also constructed in conjunction with the enclosure 510 is a waste chamber 532 through which properly bagged asbestos debris can be passed out of the work area, and equipment moved into or out of the work area, in a known manner. The waste chamber has an interior wall 534 and an exterior wall 536 which is part of the enclosure 510. Mounted in the walls 534 and 536 are single swinging doors 538 and 540, respectively, which are made in accordance with the present invention, such as preferably the doors illustrated in FIGS. 9–12. Also mounted outside the waste chamber and doorway 540 is a solid swinging door 542 which should normally remain closed against wall 536 and locked to avoid unnecessary usage of the waste chamber 532.

Figure 17:
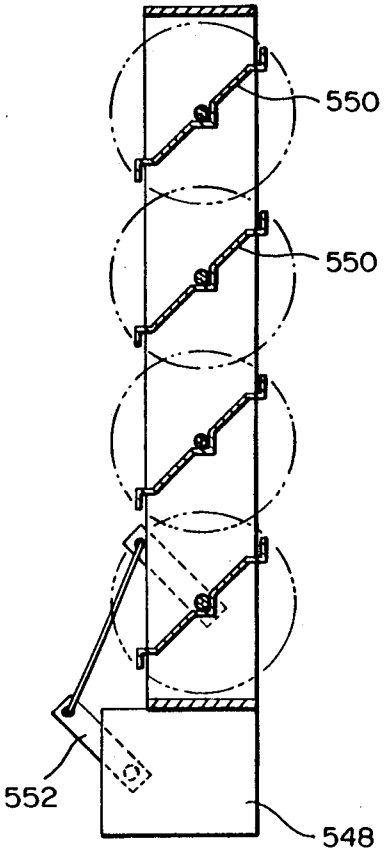
FIG. 17 is a sectional view taken along lines 17—17 of FIG. 16.
Figure 16:
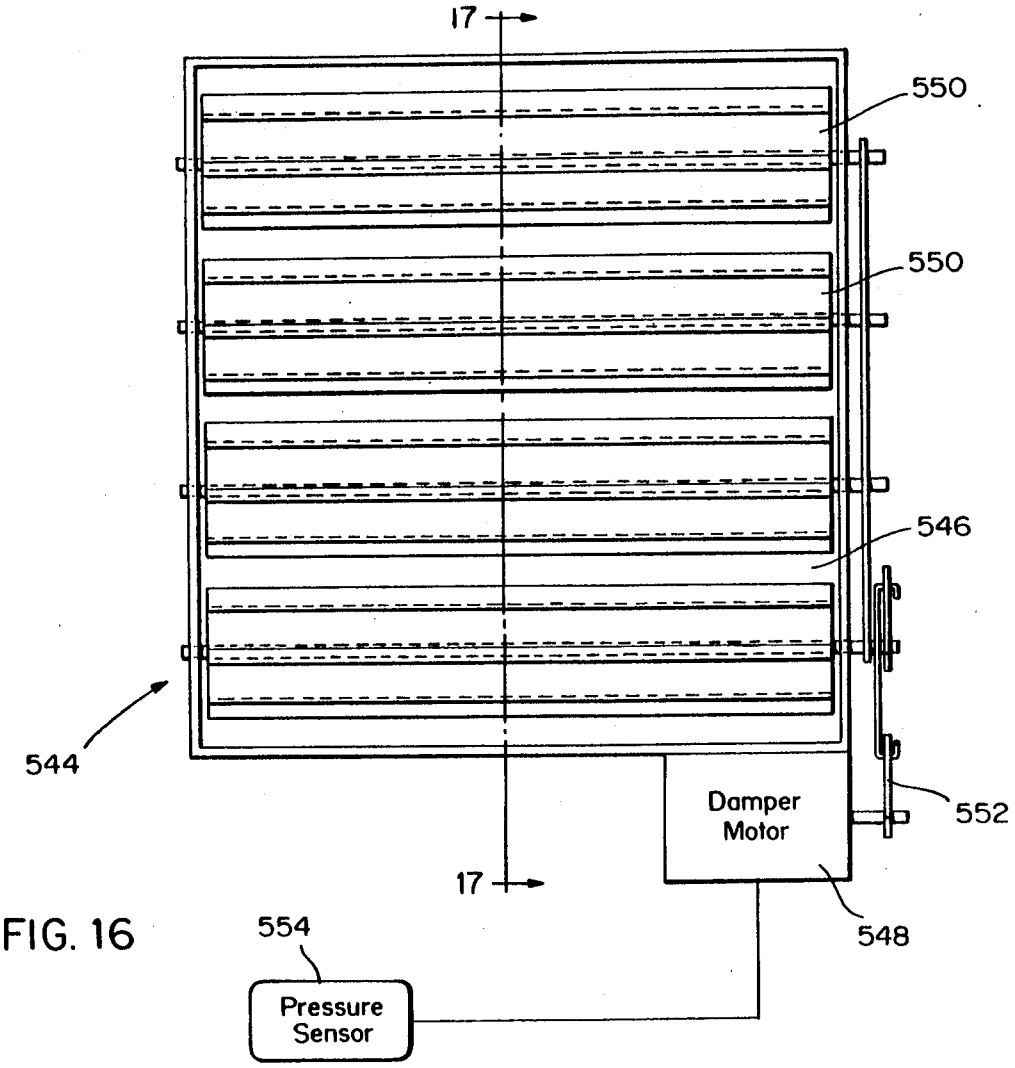
FIG. 16 is an enlarged view of the auxiliary air inlet and damper system shown in the floor plan of FIG. 15.
Figure 18:
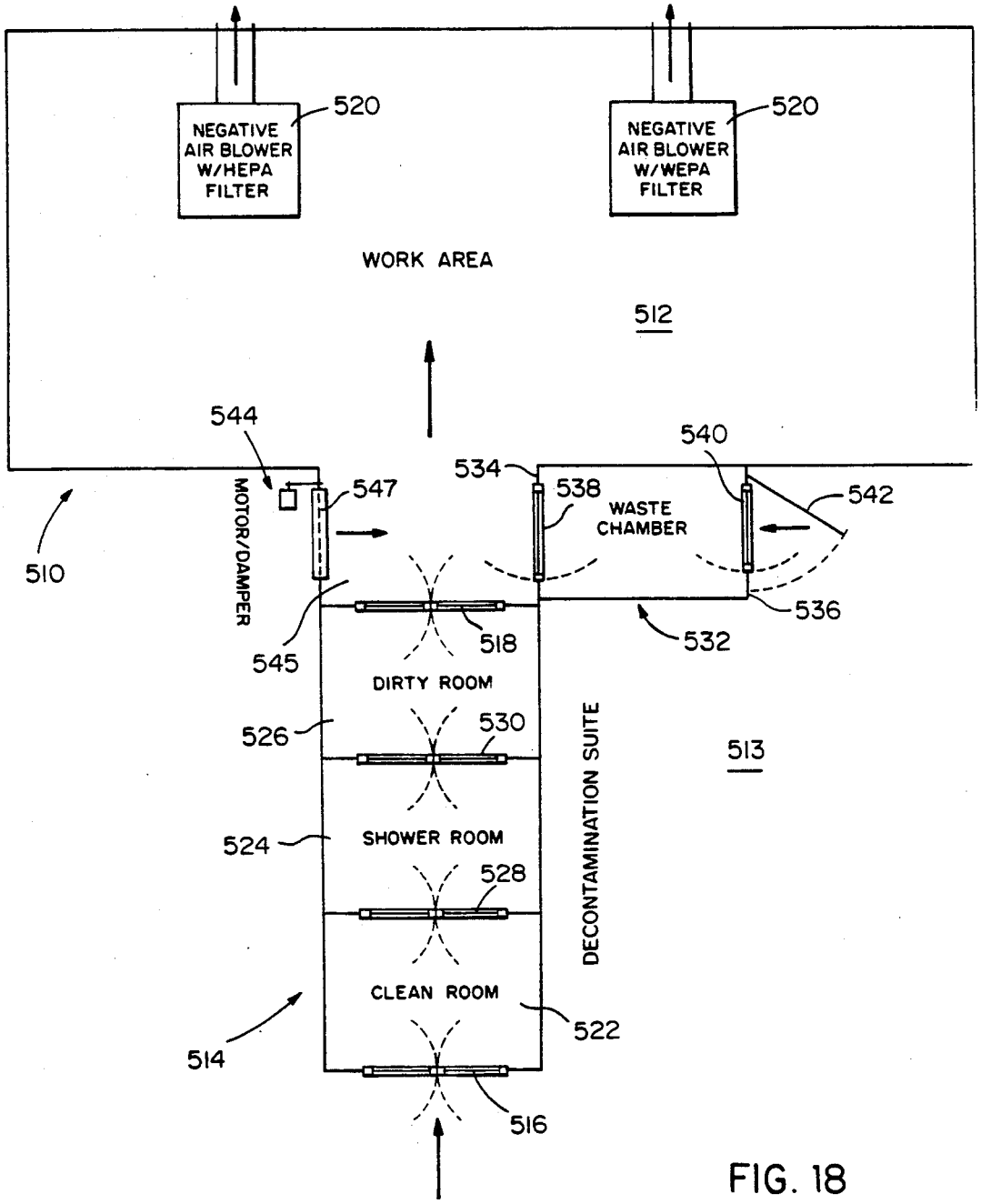
FIG. 18 is an alternate floor plan of a work area, decontamination chamber, waste chamber and auxiliary air inlet using features of the present invention.

In addition, a single auxiliary inlet opening and flap seal assembly 544 is installed in the wall of enclosure 510. The inlet opening 546 is equipped with a rigid flap damper system 547 similar to that shown in FIGS. 13 and 14, and the damper blades are electro-mechanically operated and controlled by damper motor 548. An enlarged elevation view of the rigid flap seal and damper system 544 for auxiliary inlet opening 546 is shown in FIGS. 17 and 18. As illustrated, the damper system 544 includes a series of rigid flap seals or damper blades 550. While four such blades are illustrated, any satisfactory number consistent with the size of the opening and conventional damper construction, can be utilized. While only one auxiliary inlet opening and flap seal assembly is shown in enclosure 510, any number can be used depending on the volume of air flow required for the size of work area and the size and location of the inlet opening(s) desired.

The damper blades 550 are electro-mechanically operated and controlled by damper motor 548 through mechanical linkage 552 in the manner previously described. The damper motor 548 is controlled by a pressure sensor 554 which senses and monitors the relative negative pressure in the work area 512. As illustrated in FIG. 19, far right-hand portion, the work area pressure 513 is monitored by the pressure sensor 554 which sends a signal to modulating motor 281 (motor 548 in FIG. 17) which then opens or closes the damper as needed.

For example, if the negative air pressure for the work area is designed to be 0.02 inches negative pressure, and the negative pressure falls below this predesigned setting during the asbestos removal operations; i.e. the pre-selected absolute pressure increases (as might happen when waste chamber use begins), the pressure sensor 554 will automatically signal the damper motor to close the damper system 544, thus reducing the quantity of air flow into the work area 512 through the evacuating influence of the air moving and filtration units 520. This reduction in air flow through the auxiliary inlet 546, while the air flow through the decontamination suite 514 and through the waste chamber 532, if any, remains relatively constant, will cause the negative pressure in the work area to increase. Conversely, if the negative air pressure in the work area increases from the pre-selected setting during asbestos removal operations, i.e. the absolute air pressure decreases, the pressure sensor 554 will automatically signal the damper motor 548 to open the damper system 544 and allow increased auxiliary air flow into the work area. This increased air flow will cause the negative air pressure in the work area to return to the desired prescribed setting.

It will be noted that the rigid flap elements 410 and 550 are pivotally mounted near their vertical midpoint as compared to flaps 310 which are mounted along their top edge. Any convenient mounting can be used so long as the flaps can open readily to provide the requisite air flow and close completely upon loss of negative air pressure within the work area or other condition calling for closure. In addition, it may be desirable to have the rigid flap elements spring loaded or otherwise biased toward the closed position to ensure closing action, especially when not motorized.

FIG. 18 illustrates a system for controlling the airborne contamination in an asbestos removal work area very similar to the system illustrated and described above for FIG. 15. For convenience, like numbers have been employed for the same elements. The arrangement of FIG. 18 is utilized when the walls of the enclosure 510 surrounding the area of high particulate contamination, or work area 512, are permanent and do not permit openings for the waste chamber 532 or auxiliary air inlet(s) 544. In the configuration of FIG. 18, decontamination chamber or suite 514 is constructed to allow entrance to and exit from enclosure 510 through doorway 516. However, an interior chamber or area 545 is constructed at the work area end of the decontamination suite to accommodate access of the waste chamber 532 and the auxiliary air inlet 544 to the work area through its walls as described hereinafter.

The decontamination suite 514 is still divided into the conventional clean room 522, shower room 524, and dirty room 526 which are separated by doorways 528 and 530, and doorway 518 now separates the dirty room from the interior chamber 545. The doorways 516, 528, 530 and 518, are all equipped with doors in accordance with the present invention, such as the doors illustrated in FIGS. 9–12. Preferably, at least one pair of these doors is also made in accordance with the embodiment of door construction as shown in FIGS. 13 and 14.

Waste chamber 532 has an interior wall 534 which divides it from the interior chamber 545 and mates with one side wall of the decontamination chamber, as shown in FIG. 18. The waste chamber has an exterior wall 536 which extends away from the enclosure 510. Mounted in the walls 534 and 536 are single swinging doors 538 and 540, respectively, which are made in accordance with the present invention, again such as preferably the doors illustrated in FIGS. 9–12. Also mounted outside the waste chamber and doorway 540 is the solid swinging door 542. The auxiliary inlet opening and flap seal assembly 544 is installed in the opposed wall of interior chamber 545, and it is equipped with a rigid flap damper system 547 similar to that shown and described in connection with FIGS. 13 and 14.

Furthermore, the auxiliary air inlet and flap assembly 544 and the waste chamber 532 equipped with doors in accordance with the present invention operate in the configuration of FIG. 18 in the same manner as previously described for FIG. 15. Air moving and filtration units 520 equipped with HEPA filters are placed in the contamination work area 512 within enclosure 510 in a known manner to draw substantial volumes of air into the work area through the decontamination chamber 514, the auxiliary air inlet opening 544 and the waste chamber 532, if in use, in the same manner as previously described. The arrows in FIG. 18 indicate the direction of air flow under the influence of the air moving units 520.

In controlling the rigid flap seal arrangement of the present invention for the decontamination suite, the waste chamber and the auxiliary inlet(s), as shown generally in FIGS. 15 and 18, it is desirable to control the relative air flow through each of these three type air inlets. Specifically, it is preferable to maintain the air flow through the decontamination suite 514 at all times during asbestos removal in the work area 512 to ensure that airborne asbestos is continuously swept from any part of the decontamination suite into the work area. This is important for worker safety, since workers may be exposed directly to any airborne asbestos contamination in the decontamination chamber, especially in the shower room 544 and clean room 522 where workers are no longer protected by respirator equipment. Also, sweeping airborne asbestos from the decontamination suite into the work area assures that no airborne asbestos will leak out into the uncontaminated areas 513 through doorway 516.

So long as there is the desired level of air flow through the decontamination suite, the next type air inlet to be subject to continuous air flow should be the waste chamber 532, when in use. Air flow through the waste chamber, when in use, also assures that there will be no leakage of airborne asbestos contamination to the outside environment 513 from the waste chamber. Even when the outside door 542 is shut closed and locked, air infiltration around the door, if any, will assure that there is no escape of airborne asbestos to the outside environment.

Therefore, the last type air inlet through which air flow should be created is the auxiliary air inlet or inlets 544, which may be necessary to maintain the desired negative air pressure in the work area. In other words, if the air flow through the decontamination chamber, and the waste chamber, if in use, are insufficient to keep the negative air pressure from exceeding the prescribed level, air flow can then be regulated through the auxiliary air inlets. Hence, any air inlet control system, such as the rigid flap seal embodiments contemplated in accordance with the present invention, should operate upon reduction of the negative air pressure in the work area, first to restrict and then close the air flow through the auxiliary air inlet(s), next restrict and close the air flow through the waste chamber and finally, as a last resort, restrict the air flow through the decontamination chamber.

In FIG. 19 a control system for a negative air pressure enclosure in accordance with the present invention is generally shown by reference numeral 200. The system is dependent upon a series of smoke/fire detectors as are shown and described in U.S. Pat. No. 4,818,970, incorporated herein by reference.

Two separate areas 202 and 204 labeled as Area No. 1 and Area No. 2, respectively, are representative of (1) an enclosed work area and a work area which is either adjacent to or remote from the work area or (2) are representative of two separate areas which are adjacent to or remote from an enclosed work area. Each area 202, 204 includes at least two smoke/fire sensors 206, 208, and 210, 212, labeled as Detector A and Detector B, and Detector C and Detector D, respectively. It is envisioned that each area 202 and 204 may have many more sensors than the two shown; however, it is required in this embodiment that there be at least two sensors in each area.

The sensors 206, 208, 210, 212 are connected by electrical lines 214, 216, 218, 220, respectively, to transmitters 222, 224, 226, 228, respectively, for transmission of a radio frequency (RF) signal (shown in dot/dash lines) to receiver 230. Alternately, the sensors 206, 208, 210, 212 may be hard-wire connected to receiver 230 by cables (not shown).

Receiver 230 is connected to supervised control panel 232 which includes indicators and alarms and which is monitored by trained personnel. A signal is sent from the sensors 206, 208, 210, 212 every sixty minutes or other desired time interval to the control panel 232 for monitoring the operational condition of the sensors.

When any of the sensors 206, 208, 210 or 212 detects the presence of smoke or fire, a signal is transmitted by radio frequency (from transmitter 222, 224, 226 or 228 to receiver 230) or hard-wire to the control panel 232. In the absence of a manual override by the operator of the control panel 232, an auto-dial emergency call signal is transmitted to automatic dialer 234 to initiate an emergency call to the appropriate authorities as preprogrammed.

In addition, if at least two signals are sent by sensors in Area No. 1, or if at least two signals are sent by sensors in Area No. 2 to the control panel, a signal is generated across line 236 to a transmitter 238 for transmission by radio frequency, or alternately by hard wire, to receiver 240 or receiver 242.

Receiver 240 is integral with or connected to an air moving and filter unit 241 which draws air into the work area through the doors, such as shown in FIGS. 3 through 14. The individual filtration unit 241 is deactivated by termination of power to its blower motor as is described in U.S. Pat. No. 4,818,970. By this arrangement, each of the individual filtration units 241 includes a separate receiver attuned to the frequency of transmitter 238 or directly connected to control panel 232 by line 236 for halting operation of each filtration unit upon generation of at least two signals from either of the areas 202, 204.

It is understood that there may be many additional separated areas (such as areas 202, 204) with each including at least two fire/smoke sensors. Thus, continuance of the operation of the filtration units 241 will only result upon detection of fire or smoke by at least two sensors in a single area, thus preventing shutdown of the filtration units without a confirmation of smoke or fire by more than one sensor in a particular area.

Alternately, the signal generated across cable 236 may be transmitted by transmitter 238 to receiver 242 or hard wired to receiver 242 which is connected to an electric panel circuit breaker 244. A plurality of filtration units 246 are connected to the electric panel circuit breaker 244 such that upon generation of a signal from the control panel indicative of at least two sensors in a single area detecting smoke or fire, the electric panel circuit breaker 244 is tripped, and in the absence of a manual override at the control panel, shutting off all of the filtration units 246 connected to the electric panel circuit breaker or by prior arrangement, shutting down all of the filtration units 246 except for a predetermined number of filtration units, preferably one, which would remain operative to maintain a slight negative pressure in the work area enclosure to prevent escape of asbestos particles from the work area enclosure. The single filtration unit left on should also be sufficient to draw air in through air leaks and any holes in the plastic sheeting of the work area but should be insufficient to draw open any air inlet through the negative air fire doors. Thus, an established air flow stream into the work area would be precluded so as to avoid fueling any fire that may exist.

In an alternate form of control of the filter unit or units 241 through receiver 240, the deactivating signal may come directly from individual or multiple detectors 276, which are not feed through control panel 232. Thus, one or more smoke/fire detectors 276 can send a deactivation signal to a filter unit or filter units 241 through hard wire 278 or by transmitter 280.

Separate from generation of a signal across cable 236 indicative of at least two sensors detecting fire or smoke in a single area, the receipt of a single signal from any one sensor of Area No. 1 or Area No. 2 (202, 204) will generate a signal across cable 248 from control panel 232 to transmitter 250. The signal transmitted by transmitter 250 is received by receiver 252 and receiver 254 or is alternately hard wired to the receivers 252, 254. Receiver 252 is connected to a negative air exit light and alarm 256 of the work area enclosure. Upon the detection of fire or smoke by any of sensors 206, 208, 210, 212, an emergency system of lighting is activated within the work area enclosure to facilitate the workers finding their way out of the work area enclosure. The light system may be powered by an alternate power source other than the one providing electric current to the work area enclosure due to the possibility of loss of power to the work building. Simultaneously, an alarm is signaled indicative of fire or smoke being detected in either of the separated areas 202 or 204.

Simultaneously, in the embodiments where a motorized damper system is used to electro-mechanically control rigid flaps for the air inlets into the work area enclosure, such as in FIGS. 13 through 18, the damper motors 281 are signalled by system 282 to automatically close all air inlet dampers 284. System 282 is activated by receipt of a single detector signal through receiver 279. By thus closing off all established air inlets, further drawing of substantial air into the work area enclosure is terminated. Hence, it will be seen that upon receiving a smoke/fire detection signal from a single source, all established air inlets can be automatically closed. Meanwhile, the air moving and filtration units are still activated to maintain the negative air pressure in the work area until a second confirmation signal is received, thus allowing time to investigate the potentially dangerous condition before the filter units are also shut off.

Alternatively, system 282 can be activated directly through receiver 279 by individual or multiple detectors 286 in order to automatically close all air inlet dampers 284, without going through control panel 232. One or more smoke/fire detectors 286 send a signal to receiver 279 either by transmitter 288 or hard wire 290.

In the embodiment where solid doors in the decontamination suite are opened to a variable degree by a motor to control the amount of negative air pressure in the work area enclosure, the door drive motor is disconnected by system 258 to allow the negative air doors to be released from their drive and be moved to a closed position to prevent further drawing of air into the work area enclosure. These doors, as described with reference to FIGS. 3 through 8, are double hinged to allow the workers to push open the doors to escape from the work area enclosure. The doors will automatically return to a closed position to prevent further escape of air from the work area enclosure.

Simultaneous with the generation of a signal across cable 248, when a signal is generated by sensors 206 or 208, a signal is generated across cable 260 to transmitter 262 to generate a signal to receiver 264. Upon receipt of a signal by receiver 264, exit lights 266 of a first escape route are lit. Therefore, by the generation of fire or smoke which is detected in area 204, a specific escape route is lit which is provided for escape of the workers in a direction away from area 204. Workers are thereby directed to the best escape route without knowing the actual location of a detected fire or smoke.

Similarly, when fire or smoke is detected by sensor 210 or 212, a signal is generated across cable 268 to transmitter 270 and then to receiver 272 for activation of exits lights 274 along a second escape route. The lighting of the second escape route will provide a path of escape away from the fire or smoke in area 204.

If all of the signals indicative of the detection of fire or smoke by sensors 206, 208, 210, 212 initially are registered with control panel 232, the operator may manually override any of the functions initiated by the detection of fire or smoke prior to execution of the commands caused as a result of the detection of fire or smoke. It is envisioned that the manually supervised control panel may be replaced by a central processing unit (CPU) which has been programmed to automatically direct the execution of certain commands upon the detection of predetermined conditions. However, this alternative prevents the possibility of manual intervention in the case of a false alarm unless the CPU has been preprogrammed for a test program at a predetermined time.

It is to be understood that the foregoing description and accompanying drawings set forth the preferred embodiments of the invention at the present time. Various modifications, additions and alternative designs will, of course, become apparent to those skilled in the art in light of the foregoing teachings without departing from the spirit and scope of the disclosed invention. Therefore, it should be appreciated that the invention is not limited to the disclosed embodiments but may be practiced within the full scope of the appended claims.

We claim:

1. A system for controlling access to and allowing air to flow into a sealed work area which is under negative air pressure and from which asbestos-containing material is removed, said system comprising:

wall means for isolating the sealed work area and having at least one access opening therein;

a decontamination chamber in communication with said sealed work area through said one access opening and having at least two additional access openings therein;

a rigid door assembly pivotally mounted in at least two of said access openings along a side edge for swinging movement during entry and exit of personnel to and from the sealed work area; and said door assembly including means for providing an air flow path for substantial volumes of air to enter into the work area under negative pressure and for sealing said air flow path automatically upon loss of negative air pressure in said work area.

2. A system according to claim 1, wherein said means for providing an air flow path includes a flap seal located on said door assembly on a side of said assembly facing the sealed work area to seal said air flow path upon loss of negative air pressure in the work area.

3. A system according to claim 2, wherein said flap seal is flexible film.

4. A system according to claim 2, wherein said flap seal is at least one rigid plastic element pivotally mounted across said air flow path.

5. A system according to claim 4, wherein said flap seal includes a series of rigid plastic elements pivotally mounted across said air flow path which overlap in closed position.

6. A system according to claim 4, wherein said rigid flap seal element is clear plastic to permit observation through the door assembly.

7. A system according to claim 2, wherein said door is pivotal to move in opposite directions of movement from a position of rest.

8. A door for entry to and exit from an asbestos containing work area, from which asbestos contamination is removed under negative air pressure conditions, said door comprising:

a rigid frame for pivotal mounting in a doorway for access to said asbestos containing work area;

said frame having an air inlet for passage of substantial volumes of air therethrough under the effect of negative air pressure in said work area caused by an air moving and filtration means; and rigid sealing means pivotally mounted on said frame for sealing said inlet automatically upon loss of said negative air pressure in said work area.

9. The door according to claim 8, wherein said air inlet is an air inlet opening in said frame and said rigid sealing means includes at least one rigid plastic element extending horizontally across said air inlet opening.

10. A door in accordance with claim 8, wherein said rigid sealing means is located in one side of said frame closest to said work area.

11. A door in accordance with claim 10, wherein said rigid sealing means includes at least one plastic element mounted along one edge to said one side of said frame.

12. A door in accordance with claim 11, wherein said rigid sealing means includes a series of plastic elements mounted along one edge to said one side of said frame.

13. A door in accordance with claim 8, wherein said rigid sealing means automatically seals said inlet by electro-mechanical means.

14. A door in accordance with claim 13, wherein said electromechanical means includes a pressure sensor which signals a motor to open and close said rigid sealing means.

15. A system for controlling air flow in an area where contaminated asbestos materials are being removed from a building, said system comprising:

an enclosed work area surrounding where asbestos contamination is being removed;

a rigid door pivotally mounted adjacent the work area for swinging movement during worker access into and out of the work area;

means for establishing at least one air flow inlet opening from outside the enclosed work area into said enclosed work area;

at least one air moving and filtration unit for filtering air in the work area, for producing a negative air pressure in the work area, and for drawing air into the work area through said air flow inlet opening; and means for automatically closing said air flow inlet opening upon sensing a fire, smoke or other emergency within said building.

16. The system of claim 15, and further comprising:

at least one area of said building having at least two sensor means for detecting smoke or fire and for generating a signal upon detection of fire or smoke, control means for receiving a signal from each of said at least two sensor means indicative of the presence of smoke or fire, means for closing said air flow inlet opening upon receipt by said control means of one signal from said at least two sensor means, and means for disabling said at least one air moving and filtration unit upon receipt by said control means of signals from both said at least two sensor means.

17. The system of claim 16, wherein there are multiple air moving and filtration units and said disabling means disables all but one of said filtration units.

18. The system of claim 16, wherein said at least one area is located in the work area.

19. The system of claim 16, wherein said at least one area is located outside of the work area.

20. The system of claim 16, and further comprising lighting means for lighting an escape route upon detection of fire or smoke by one of said at least two sensor means, the escape route extending away from the detected fire or smoke.

21. The system of claim 16, wherein said at least one area includes two areas each having said at least two sensing means with separate lighting means provided for each of said two areas for lighting an escape route away from an area in which fire or smoke is detected upon detection of fire or smoke by one of said at least two sensors.

22. The system of claim 15, wherein said rigid door includes a frame and said air flow inlet opening is within said frame.

23. The system of claim 15, wherein said means for automatically closing said air flow inlet opening is a pivotally mounted rigid flap means.

24. The system of claim 23, wherein said rigid flap means is a series of rigid plastic panels extending horizontally across said opening.

25. The system of claim 23, wherein said rigid flap means is electro-mechanically controlled.

26. The system of claim 15, wherein said automatic means for closing the air flow inlet opening is electro-mechanically controlled.

27. The system of claim 15, and further comprising a decontamination chamber associated with said rigid door such that worker access into and out of the work area must be through said decontamination chamber.

28. The system of claim 22, wherein said means for automatically closing said air flow inlet opening is a pivotally mounted rigid flap means.

29. A method for controlling air flow in an area where contaminated asbestos materials are being removed from a building, which comprises:

constructing an enclosed space surrounding an area where asbestos contamination is to be removed;

providing worker access into and out of said enclosed space through a rigid door pivotally mounted for swinging movement;

establishing at least one air flow inlet through said rigid door from outside the enclosed space into said enclosed space;

continuously evacuating substantial volumes of air from said enclosed space through a HEPA filter means and continuously drawing substantial volumes of air into said enclosed space through air flow inlet opening to remove dangerous airborne asbestos fibers in said enclosed space and to establish a negative air pressure in said enclosed space; and automatically closing said air flow inlet opening upon loss of negative air pressure in the enclosed space or other command signal due to changed conditions within said building.

30. The method of claim 29, wherein the rate of evacuation of air from said enclosed space is sufficient to change the air within the enclosed space at least about every ten minutes.

31. The method of claim 29, and further comprising erecting temporary wall means to define said enclosed space and installing said rigid door within said temporary wall means.

32. The method of claim 31, and further comprising erecting a decontamination chamber as part of said temporary wall means and providing at least two rigid doors with air flow inlets.

33. A decontamination chamber for providing worker access between an enclosed work area, where contaminated asbestos materials are being removed from inside a building, and a relatively clean environment outside the work area, which chamber comprises:

at least a clean room and dirty room through which workers must pass in order to gain entrance to and exit from said enclosed work area;

a rigid door mounted in a doorway for access to the clean room from the outside environment;

a rigid door pivotally mounted in a doorway between the clean room and dirty room;

both said rigid doors providing at least one air flow inlet opening through which substantial volumes of air from the outside environment can sweep through the decontamination chamber into the enclosed work area; and means for automatically closing said air flow inlet openings upon loss of negative air pressure in the enclosed space.

34. A decontamination chamber in accordance with claim 33, wherein both said rigid doors include a frame and said air flow inlet opening is within said frame.

35. A decontamination chamber in accordance with claim 33, wherein said means for automatically closing said air flow inlet opening is a pivotally mounted rigid flap means.

36. A decontamination chamber in accordance with claim 35, wherein said rigid flap means of at least one of said rigid doors is electro-mechanically controlled.

37. A decontamination chamber in accordance with claim 33, wherein said automatic means for closing the air flow inlet opening is electro-mechanically controlled.

38. A decontamination chamber in accordance with claim 33, wherein said clean room and dirty room are separated by a shower room and rigid doors are pivotally mounted in doorways between the clean room and shower room, and between the shower room and dirty room;

a rigid door pivotally mounted in a doorway between the dirty room and the enclosed work area; and all said rigid doors providing at least one air flow inlet opening through which substantial volumes of air from the outside environment can sweep through the decontamination chamber into the enclosed work area.

39. A decontamination chamber in accordance with claim 38, wherein the rigid door between the dirty room and the enclosed work area is spaced from entry to the enclosed work area to accommodate an additional air flow inlet in walls of the decontamination chamber.

40. A negative pressure enclosure for a work area in which dangerous solid asbestos contamination is being removed which comprises:

wall means including a portion of the existing wall structure in said building and temporary wall means erected to complete the enclosure;

a rigid door pivotally mounted in said temporary wall means for swinging movement during worker access into and out of the enclosure;

means for establishing at least one air flow inlet opening from outside the enclosed work area into said enclosed work area;

at least one air moving and filtration unit for filtering air in the work area, for producing a negative air pressure in the work area, and for drawing air into the work area through said air flow inlet opening; and means for automatically closing said air flow inlet opening upon sensing a fire, smoke or other emergency within said building.

41. A negative pressure enclosure in accordance with claim 40, wherein said rigid door includes a frame and said air flow inlet opening is within said frame.

42. A negative pressure enclosure in accordance with claim 40, wherein said means for automatically closing said air flow inlet opening is a pivotally mounted rigid flap means.

43. A negative pressure enclosure in accordance with claim 42, wherein said rigid flap means is electro-mechanically controlled.

44. A negative pressure enclosure in accordance with claim 40, wherein said automatic means for closing the air flow inlet opening is electro-mechanically controlled.

45. A negative pressure enclosure in accordance with claim 40, and further including a decontamination chamber associated with said rigid door such that work access into and out of the enclosure must be through said decontamination chamber.

46. An air inlet and sealing means for providing air flow into an enclosed negative air asbestos removal work area, which comprises:

an air flow inlet opening in a temporary wall erected for constructing said enclosed work area;

said air flow inlet opening capable of allowing substantial volumes of air to pass from outside said work area into said work area under the effect of negative air pressure in said work area caused by an air moving and filtration means; and rigid sealing means pivotally mounted for sealing said air flow inlet opening automatically upon loss of negative air pressure in said work area or other command signal due to changed conditions within said building.

47. An air inlet and sealing means in accordance with claim 46, wherein said rigid sealing means includes at least one rigid plastic element extending horizontally across said air flow inlet opening.

48. An air inlet and sealing means in accordance with claim 46, wherein said rigid sealing means is located inside the air flow inlet opening and mounted on the temporary wall.

49. An air inlet and sealing means in accordance with claim 48, wherein said rigid sealing means includes at least one rigid plastic element mounted along one edge to said temporary wall.

50. An air inlet and sealing means in accordance with claim 46, wherein said rigid sealing means automatically seals said inlet opening by electro-mechanical means.

51. An air inlet and sealing means in accordance with claim 50, wherein said electro-mechanical means includes a pressure sensor which signals a motor to open and close said rigid sealing means.

* * * * *